US005838105A

United States Patent [19]

Mitomo

[11] Patent Number: 5,838,105

[45] Date of Patent: Nov. 17, 1998

[54] PLASMA DISPLAY PANEL INCLUDING COLOR FILTERS

[75] Inventor: Hiroyuki Mitomo, Koufu, Japan

[73] Assignee: Pioneer Electronic Corporation, Tokyo, Japan

[21] Appl. No.: 848,257

[22] Filed: Apr. 29, 1997

[30] Foreign Application Priority Data

May 9, 1996 [JP] Japan ..... 8-139533
Oct. 30, 1996 [JP] Japan ..... 8-303878

[51] Int. Cl.[6] ..... H01J 5/16

[52] U.S. Cl. ..... 313/582; 313/112; 313/587

[58] Field of Search ..... 313/112, 584, 313/582, 586, 587, 478, 489, 422, 495, 496, 497

[56] References Cited

U.S. PATENT DOCUMENTS 4,626,071 12/1986 Wada et al. ..... 359/885
4,661,743 4/1987 Matsuoka et al. ..... 313/112
4,703,229 10/1987 Nighan et al. ..... 313/582
5,336,121 8/1994 Baret ..... 313/586
5,541,479 7/1996 Nagakubo ..... 313/586
5,635,006 6/1997 Watanabe et al. ..... 427/68

*Primary Examiner*—Nimeshkumar Patel
*Assistant Examiner*—Michael Day
*Attorney, Agent, or Firm*—Evenson, McKeown, Edwards & Lenahan, PLLC

[57] ABSTRACT

A plasma display panel with an increased display contrast improves a visibility of the display at low costs. A green light absorbing filter is provided on the outer surface of a substrate on the display surface side and a monochromatic light transmitting filter corresponding to at least one of red and blue fluorescent material layers which face each other through a discharge space is provided on the inner surface of the substrate on the display surface side. The green light absorbing filter is provided on the outer surface of the substrate on the display surface side and at least one of the red and blue fluorescent material layers is formed by a fluorescent material layer colored so as to absorb the light in wavelength regions other than the corresponding monochromatic light.

8 Claims, 14 Drawing Sheets

PLASMA DISPLAY PANEL INCLUDING COLOR FILTERS

BACKGROUND OF THE INVENTION

1. Field of the Invention

The present invention relates to a plasma display panel (PDP) with which a color display is performed by the provision of a fluorescent material layer emitting light by the discharge and, more particularly, to a PDP having an enhanced contrast of image display to perform clear color display.

2. Description of Related Art

Hitherto, among PDPs performing a matrix type display, an AC (alternating current) drive PDP of a surface discharging type having a 3-electrode structure adapted to display a predetermined color by a fluorescent material is known. This surface discharging type AC PDP of the 3-electrode structure has a structure such that: a plurality of sustain electrode pairs extending in parallel in the horizontal direction are provided on the inner surface of a substrate on the display surface side, of a pair of substrates which face each other via a discharge space; a plurality of address electrodes, which are covered with an MgO layer and extend in the vertical direction on the inner surface of the substrate on the back surface side, are arranged; partition walls (ribs) are provided in a stripe shape between the address electrodes; and a fluorescent material layer is formed so as to cover the side surfaces of the ribs and the address electrodes, thereby integrally sealing the pair of substrates on the display surface side and the back surface side.

In the PDP, however, there is a problem that the display contrast deteriorates by the reflection of light from outside (ambient light). To cope with this type of problem, the use of the following measure(s) is conceivable.

(1) Attaching a filter for absorbing light in a specific wavelength region and transmitting light in other wavelength regions onto the whole outer surface of the substrate of the PDP on the display surface side.

(2) Forming filters of three colors consisting of a red light transmitting filter, a green light transmitting filter, and a blue light transmitting filter in correspondence to fluorescent material layers of three colors of red, green, and blue of the PDP.

In the case of using the externally attached filter as the measure (1), however, an effect to improve the contrast by reducing a reflectance of the display surface is insufficient. In the case of using the three color filters as the measure (2), the production steps of forming such filters are complicated although the contrast of the display surface is sufficiently improved.

OBJECTS AND SUMMARY OF THE INVENTION

In view of the above circumstances, it is an object of the invention to enhance a contrast of a display and to improve a visibility of a display at low costs.

According to the first aspect of the invention, there is provided a plasma display panel which has a pair of substrates on a display surface side and a back surface side that are arranged so as to face each other via a discharge space and fluorescent material layers of three colors of red, green, and blue that are provided on the inner surface of the substrate on the back surface side and in which the fluorescent material layers emit light by the discharge, wherein a green light absorbing filter is provided on the outer surface of the substrate on the display surface side and a monochromatic light transmitting filter corresponding to at least one of the red and blue fluorescent material layers which face via the discharge space is provided on the inner surface of the substrate on the display surface side.

According to the second aspect of the invention, in the plasma display panel according to the first aspect of the invention, the green light absorbing filter has transmitting characteristics such that a transmittance in a wavelength region near 555 nm lies in a range from 40 to 80% and a transmittance in wavelength regions of the red light and blue light is higher than the transmittance in a wavelength region near 555 nm by 10% or more.

According to the third aspect of the invention, in the plasma display panel according to the first aspect of the invention, monochromatic light transmitting filters corresponding to the fluorescent material layers of red and blue which face via the discharge space are provided on the inner surface of the substrate on the display surface side, and the fluorescent material layer of green is constructed by a fluorescent material layer colored so as to absorb light in wavelength regions other than the green light.

According to the fourth aspect of the invention, in the plasma display panel according to the first aspect of the invention, a red light transmitting filter corresponding to the fluorescent material layer of red which faces via the discharge space is provided on the inner surface of the substrate on the display surface side and at least one of the fluorescent material layers of green and blue is constructed by a fluorescent material layer colored so as to absorb light in wavelength regions other than the corresponding monochromatic light.

According to the fifth aspect of the invention, in the plasma display panel according to the first aspect of the invention, a blue light transmitting filter corresponding to the fluorescent material layer of blue which faces via the discharge space is provided on the inner surface of the substrate on the display surface side and at least one of the fluorescent material layers of red and green is constructed by a fluorescent material layer colored so as to absorb light in wavelength regions other than the corresponding monochromatic light.

According to the sixth aspect of the invention, there is provided a plasma display panel which has a pair of substrates on a display surface side and a back surface side which are arranged so as to face each other via a discharge space and fluorescent material layers of three colors of red, green, and blue provided on the inner surface of the substrate on the back surface side and in which the fluorescent material layers emit light by the discharge, wherein a green light absorbing filter is provided on the outer surface of the substrate on the display surface side and at least one of the fluorescent material layers of red and blue is constructed by a fluorescent material layer colored so as to absorb light in wavelength regions other than the corresponding monochromatic light.

According to the seventh aspect of the invention, in the plasma display panel according to the sixth aspect of the invention, the green light absorbing filter has transmitting characteristics such that the transmittance in a wavelength region near 555 nm lies within a range from 40 to 80% and the maximum transmittance in wavelength regions of red light and blue light is higher than the transmittance in a wavelength region near 555 nm by 10% or more.

According to the eighth feature, in the plasma display panel according to the sixth aspect of the invention, a green light transmitting filter corresponding to the fluorescent material layer of green which faces via the discharge space is provided on the inner surface of the substrate on the display surface side.

According to the invention, since the green light absorbing filter is provided on the outer surface of the substrate on the display surface side and the monochromatic light transmitting filter (filter for absorbing light in wavelength regions other than the corresponding monochromatic light) corresponding to at least one of the fluorescent material layers of red and blue which face via the discharge space are provided, the plasma display panel in which the contrast of the display is enhanced and the visibility of the display is improved at low costs can be provided. By using the colored fluorescent material layers, the reduction of the reflection of the outside light in which a manufacturing step is simple and which can withstand a practical use can be realized.

DETAILED DESCRIPTION OF THE PREFERRED EMBODIMENTS (First embodiment)

Figure 1:
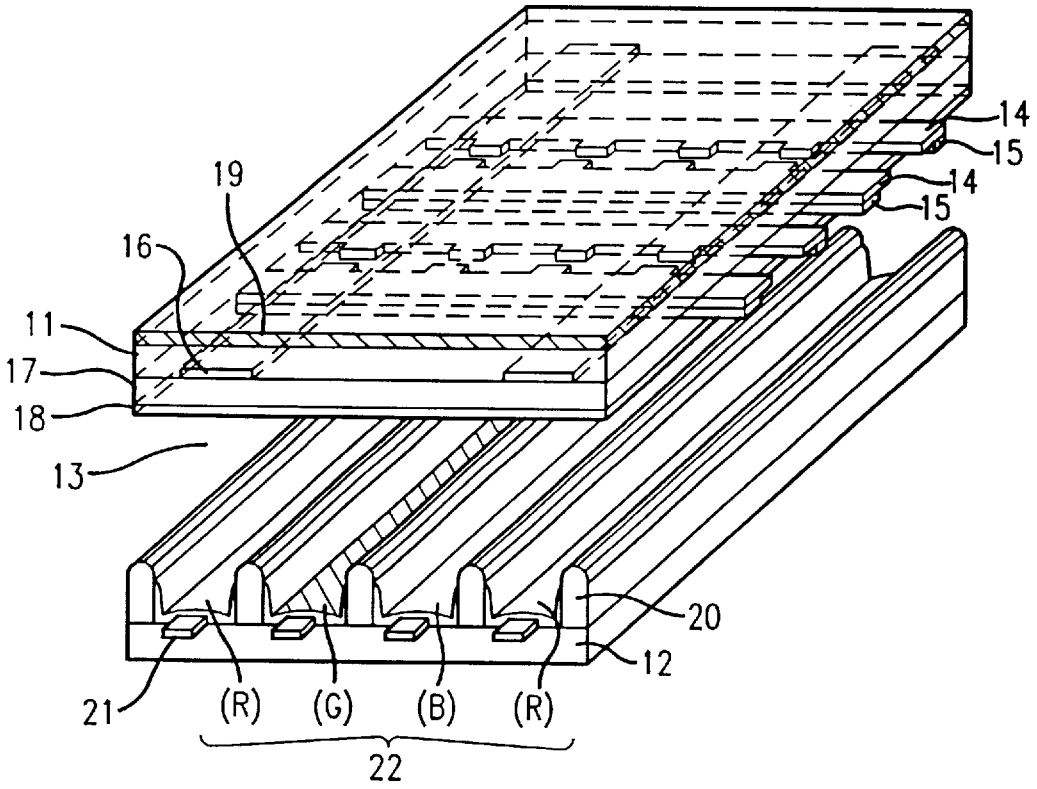
FIG. 1 is a diagram showing a structure of a PDP of the invention.

The first embodiment of the invention will be described hereinbelow with reference to FIGS. 1 to 4. FIG. 1 is a perspective view of a PDP in the invention.

The PDP has a pair of substrates, namely, the front glass substrate 11 and a back glass substrate 12 which are arranged so as to face each other via a discharge space 13. On the inner surface of the front glass substrate 11 on the display surface side, various electrodes and layers are formed which include, sustain electrode pairs each of which is constituted by transparent electrodes 14 made of a transparent conductive film and bus electrodes 15 made of a metal film for supplementing a conductivity of the transparent conductive film, a dielectric material layer 17 covering the sustain electrode pairs, and an MgO layer 18 covering the dielectric material layer. On the back glass substrate 12 on the back surface side, there are provided address electrodes 21 arranged in the direction which crosses the surfaces of the sustain electrode pairs, fluorescent material layers 22 of three primary colors of red (R), green (G), and blue (B), and stripe-shaped ribs 20 partitioning the discharge space 13. A discharge gas in which xenon is mixed in neon is enclosed in the discharge space 13.

A green light absorbing filter 19 constituted by an acrylic resin plate or the like in which pigment, coloring material, or the like which absorbs the green light is mixed is attached to the whole outer surface of the front glass substrate 11. A red light transmitting filter 16 is formed by a screen printing or the like on the surface corresponding to the fluorescent material layer 22 on the inner surface of the front glass substrate 11, that is, the surface which faces the red fluorescent material layer in FIG. 1.

The bus electrode 15 is constructed by a double-layer metal film of chromium (Cr) and aluminum (Al). For example, chromium and aluminum are sequentially sputtered or evaporation deposited and are patterned by using a photolithographic method.

Figure 2:
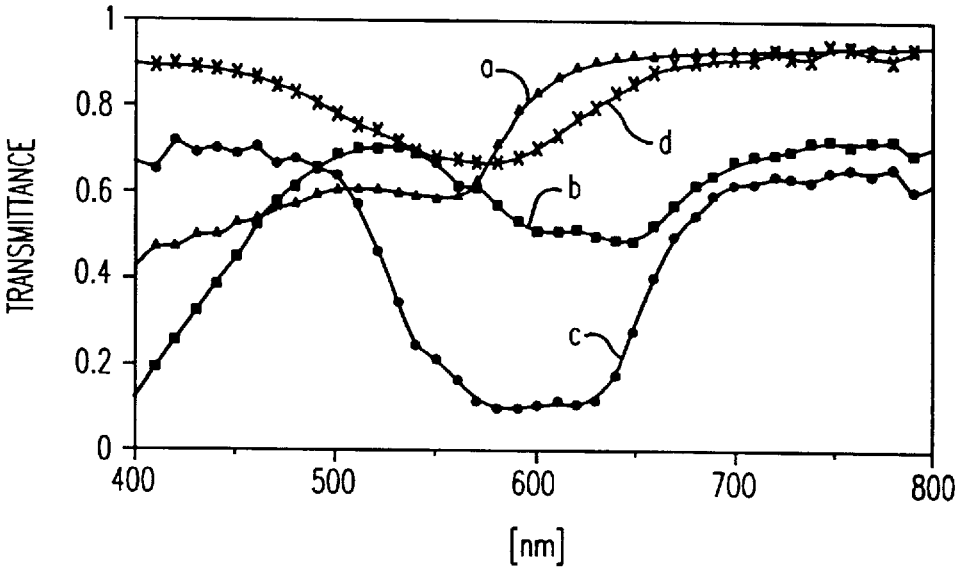
FIG. 2 is a graph showing a transmittance of each filter of the PDP of the invention.

FIG. 2 shows the transmittance of each of the red, green, and blue filters for the inner surface of the front glass substrate and the externally attached green light absorbing filter with respect to light wavelength. Each of the color filters other than the externally attached filter includes a transmittance of the substrate. In FIG. 2, reference letters "a", "b", and "c" denotes characteristic curves of the red, green, and blue filters, and "d" shows characteristic curve of the externally attached green light absorbing filter.

In case of the externally attached green light absorbing filter having the characteristic curve "d" in FIG. 2, the transmittance in a wavelength region near 555 nm where the spectral luminous is the highest is about 70% and the maximum transmittance in red and blue regions are higher than the transmittance in the region near 555 nm by 10% or more.

Figure 3:
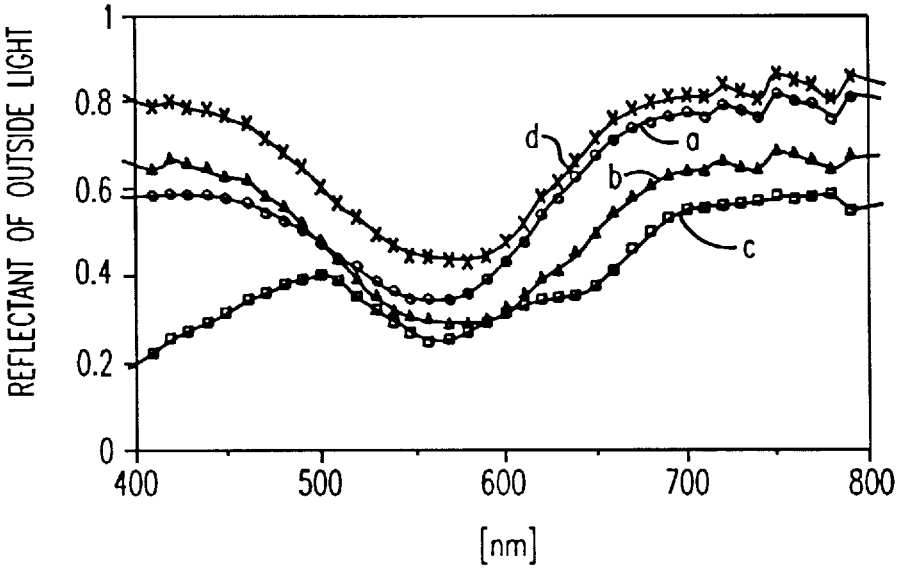
FIG. 3 is a graph showing an outside light reflectance of each filter of the PDP of the invention.

FIG. 3 shows reflectance curves of light from outside when using the filters shown in FIG. 2: namely, the letter "a" denotes a curve obtained when the red light transmitting filter is provided on the inner surface of the substrate and the green light absorbing filter is provided on the outside; "b"

denotes a curve obtained when the blue light transmitting filter is provided on the inner surface of the substrate and the green light absorbing filter is provided on the outside; "c" denotes a curve obtained when the red, green, and blue filters are provided in correspondence to the red, green, and blue fluorescent material layers on the inner surface of the substrate; and "d" denotes a curve obtained when only the green light absorbing filter is provided on the outside. In FIG. 3, curves are shown with a scale that a reflectance of the outside light when using no filter corresponds to a value "1".

As will be readily understood from FIG. 3, in the wavelength region near 555 nm where the spectral luminous is the highest, the outside light reflectance of each of (a), (b), and (c) decreases as compared with (d) in case of using only the externally attached filter. Each of (a) in case of using the red light transmitting filter and (b) in case of using the blue light transmitting filter shows the outside light reflectance which is close to that of the case (c) where the filters of three colors are provided.

Figure 4:
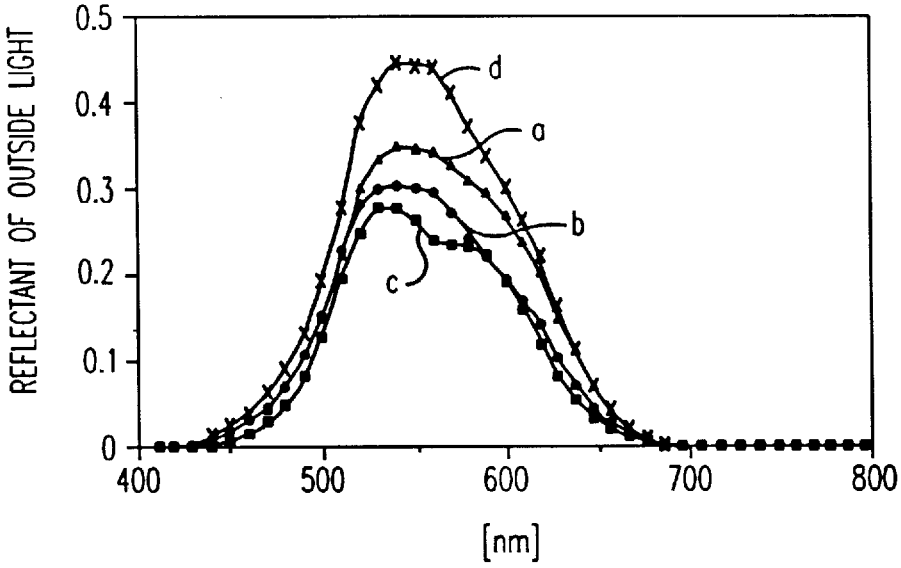
FIG. 4 is a graph showing the outside light reflectance in which a spectral luminous of each filter of the PDP of the invention is considered.

FIG. 4 shows outside light reflectance curves in consideration of the spectral luminous for the curves shown in FIG. 3. Reference letters "a", "b", "c", and "d" together show the same combination of the curves as those of FIG. 3. In this case as well, characteristic curves are shown in the scale that the outside light reflectance when using no filter corresponds to "1". As will be obviously understood from FIG. 4, an effect to sufficiently reduce the outside light reflectance is shown in a range of visible light.

Figure 5:
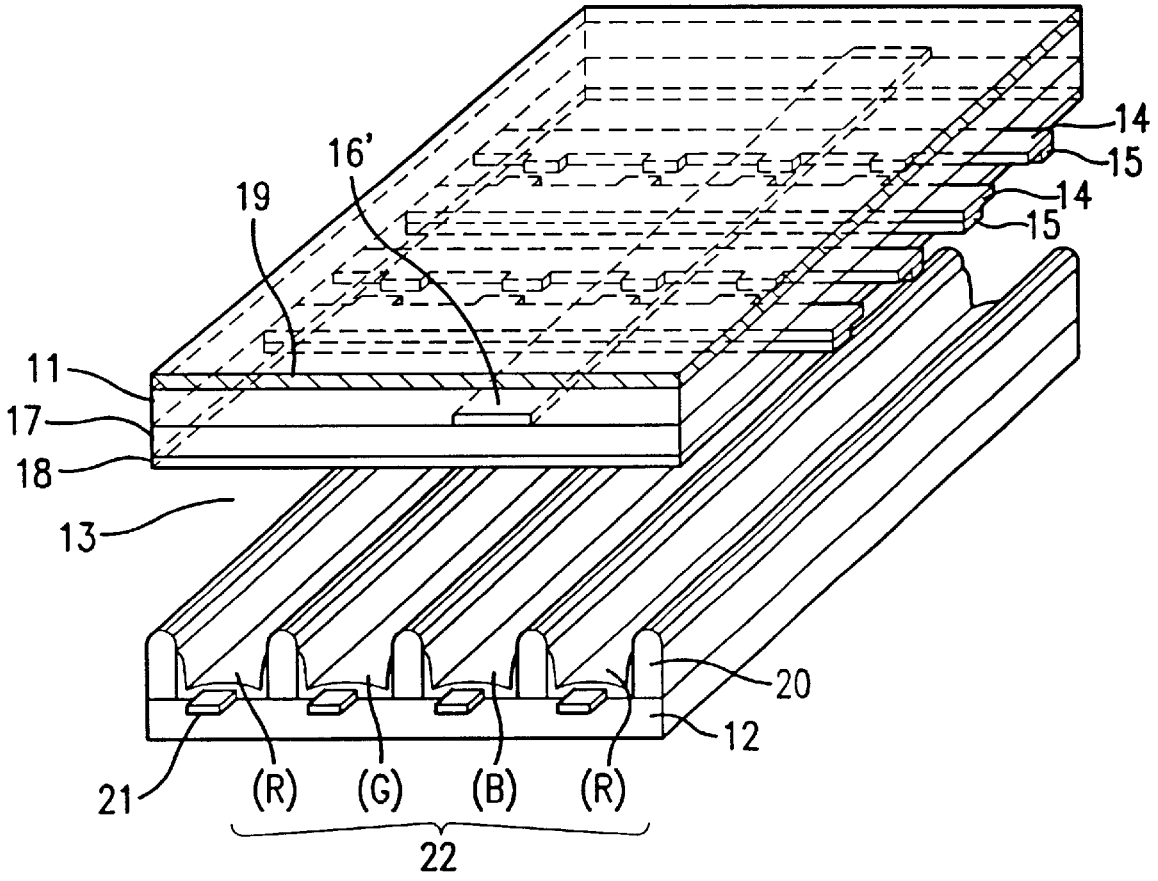
FIG. 5 is a diagram showing structure of the PDP with a blue light transmitting filter provided on the inner surface of the substrate.
Figure 6:
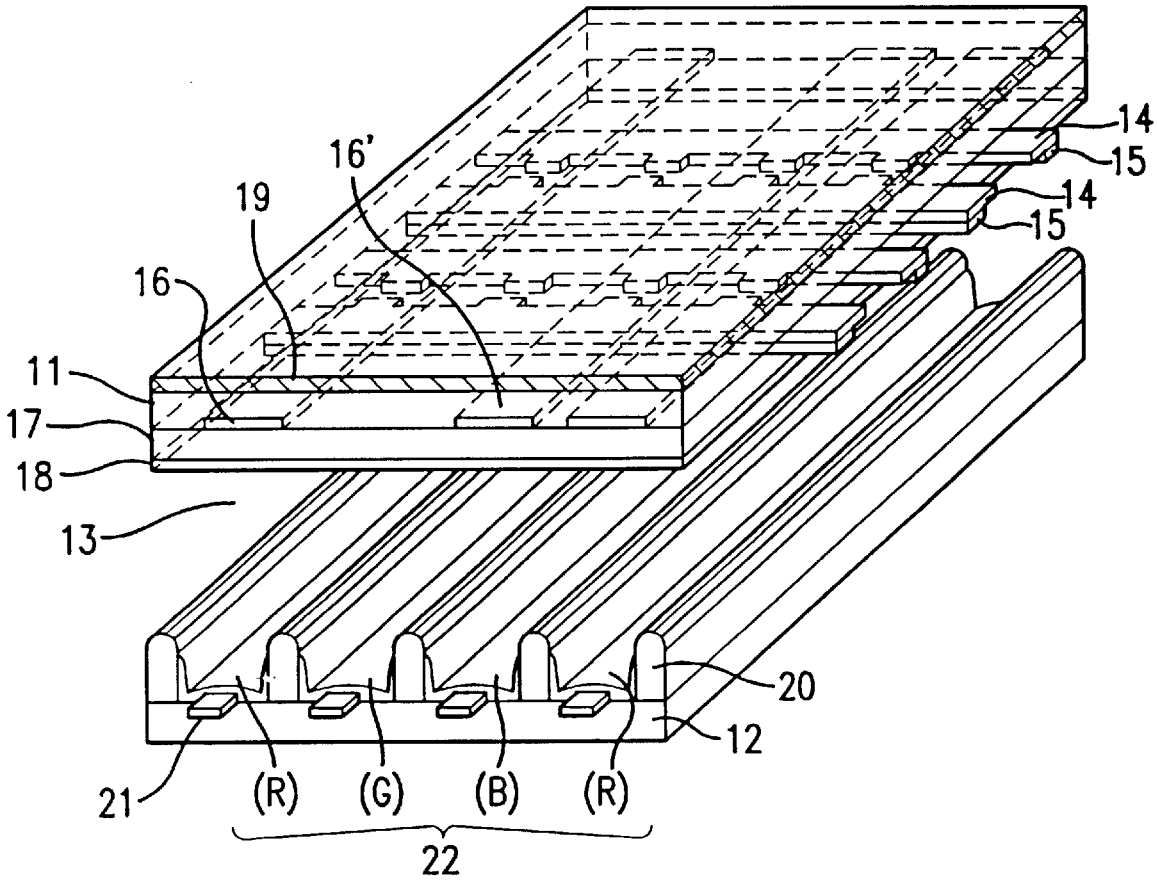
FIG. 6 is a diagram showing structure of the PDP with both red light and blue light transmitting filters provided on the inner surface of the substrate.
Figure 7:
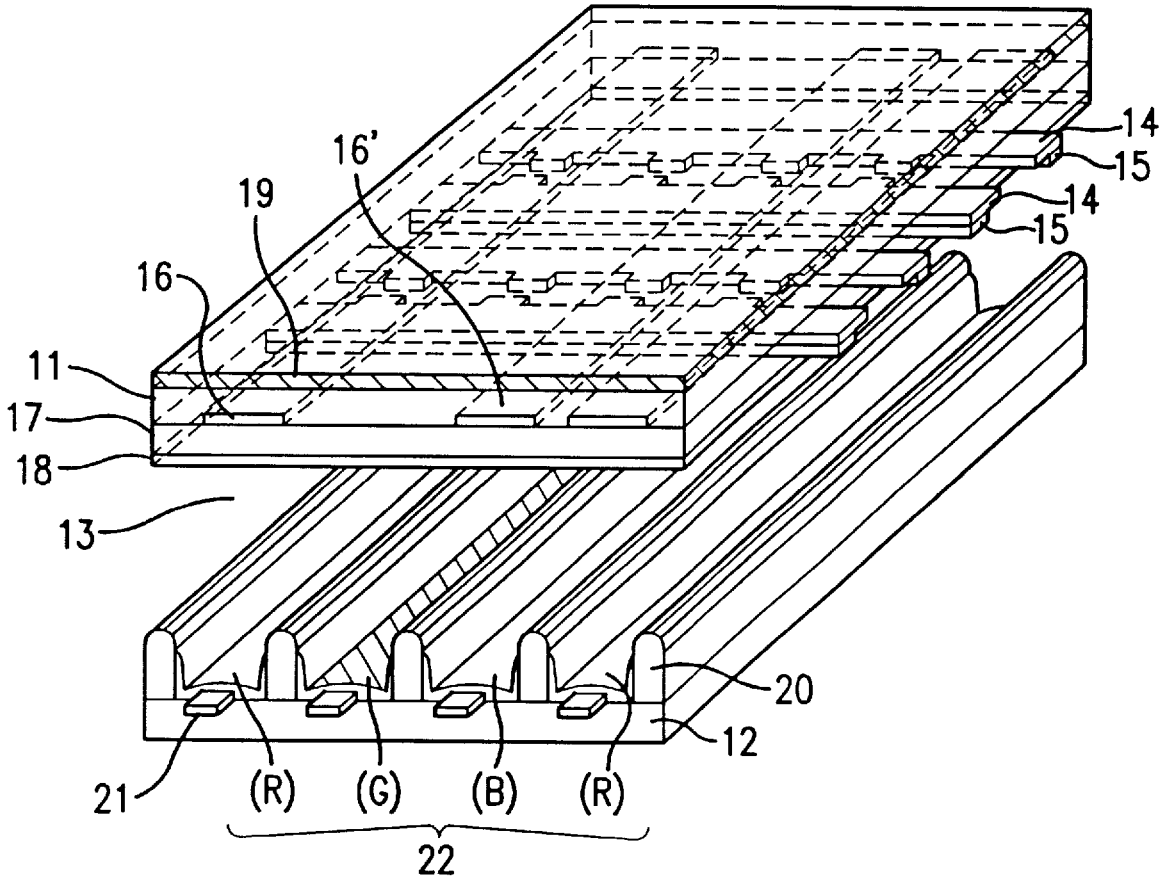
FIG. 7 is a diagram showing structure of the PDP with both red light and blue light transmitting filters provided on the inner surface of the substrate along with a flourescent material layer colored to absorb light in green wavelength regions.
Figure 8:
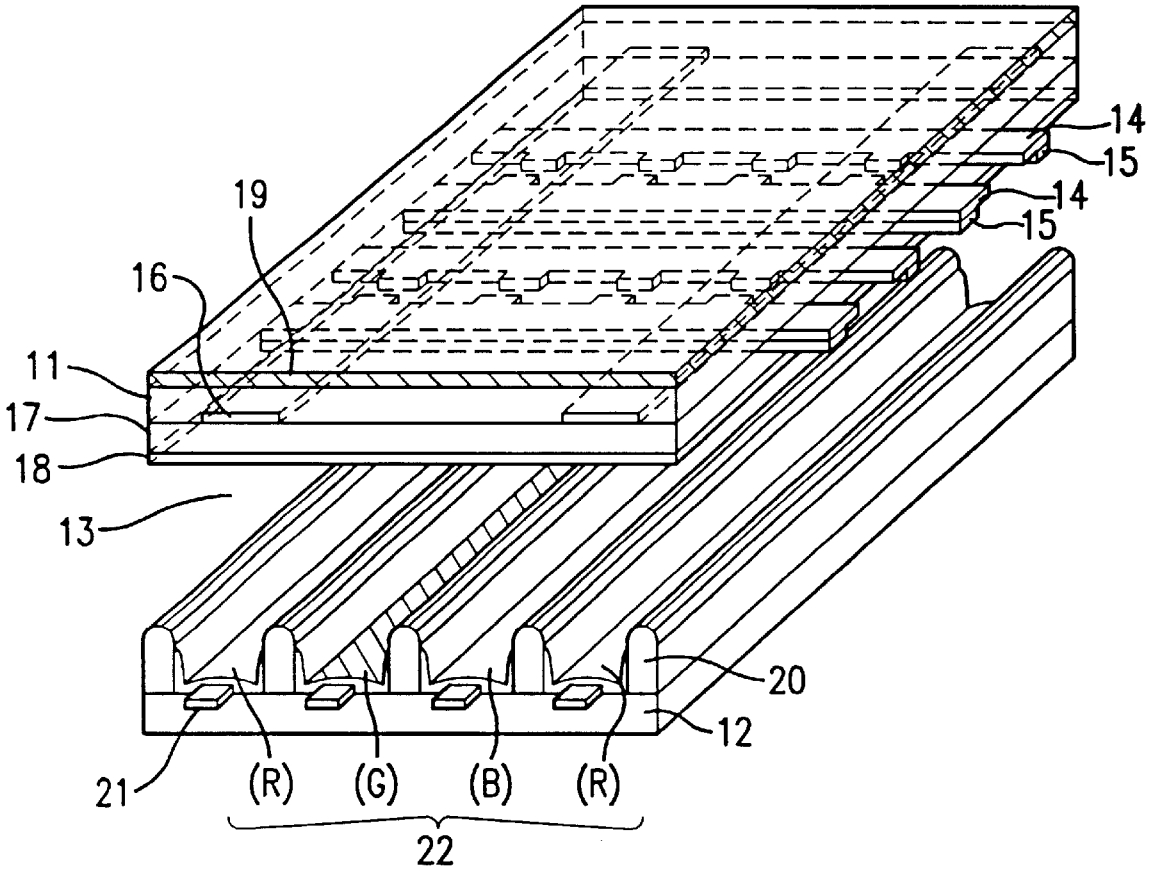
FIG. 8 is a diagram showing structure of the PDP with red light transmitting filters provided on the inner surface of the substrate along with a flourescent material layer colored to absorb light in green wavelength regions.
Figure 9:
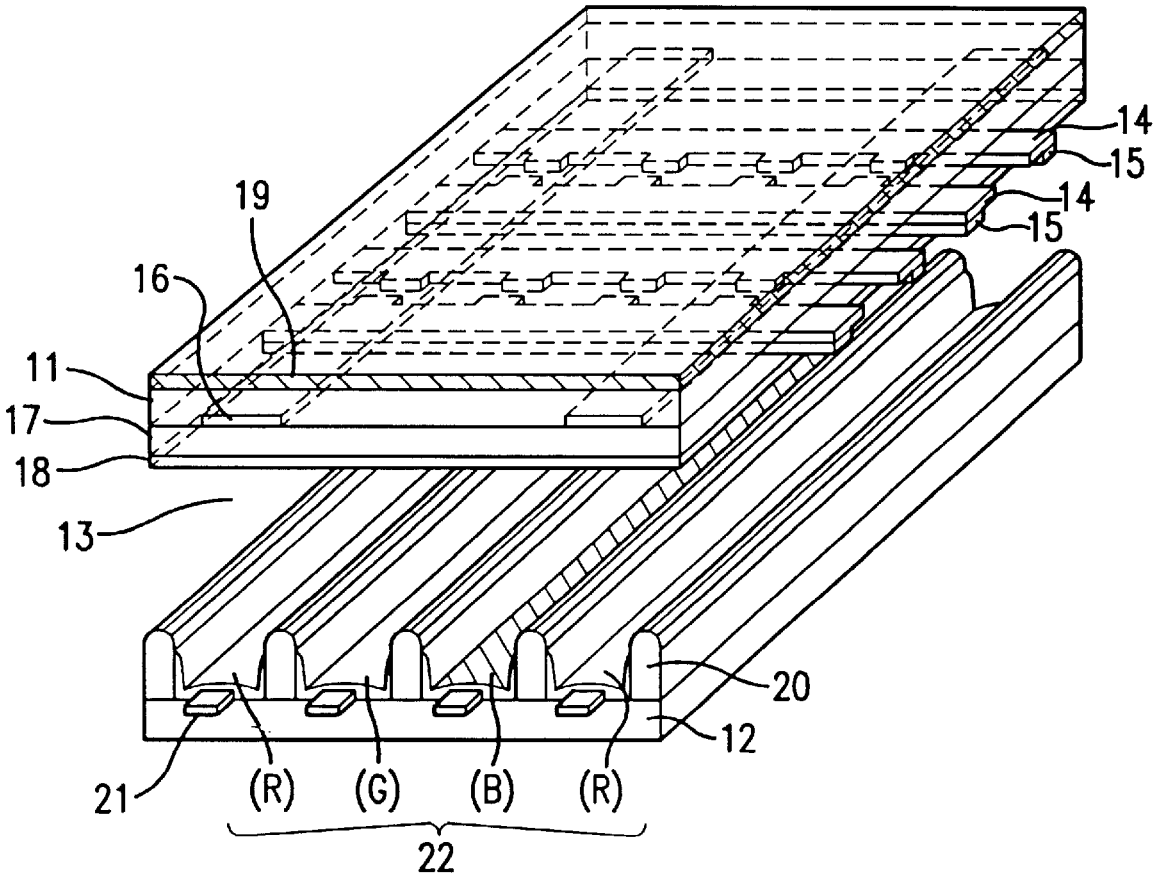
FIG. 9 is a diagram showing structure of the PDP with red light transmitting filters provided on the inner surface of the substrate along with a flourescent material layer colored to absorb light in blue wavelength regions.
Figure 10:
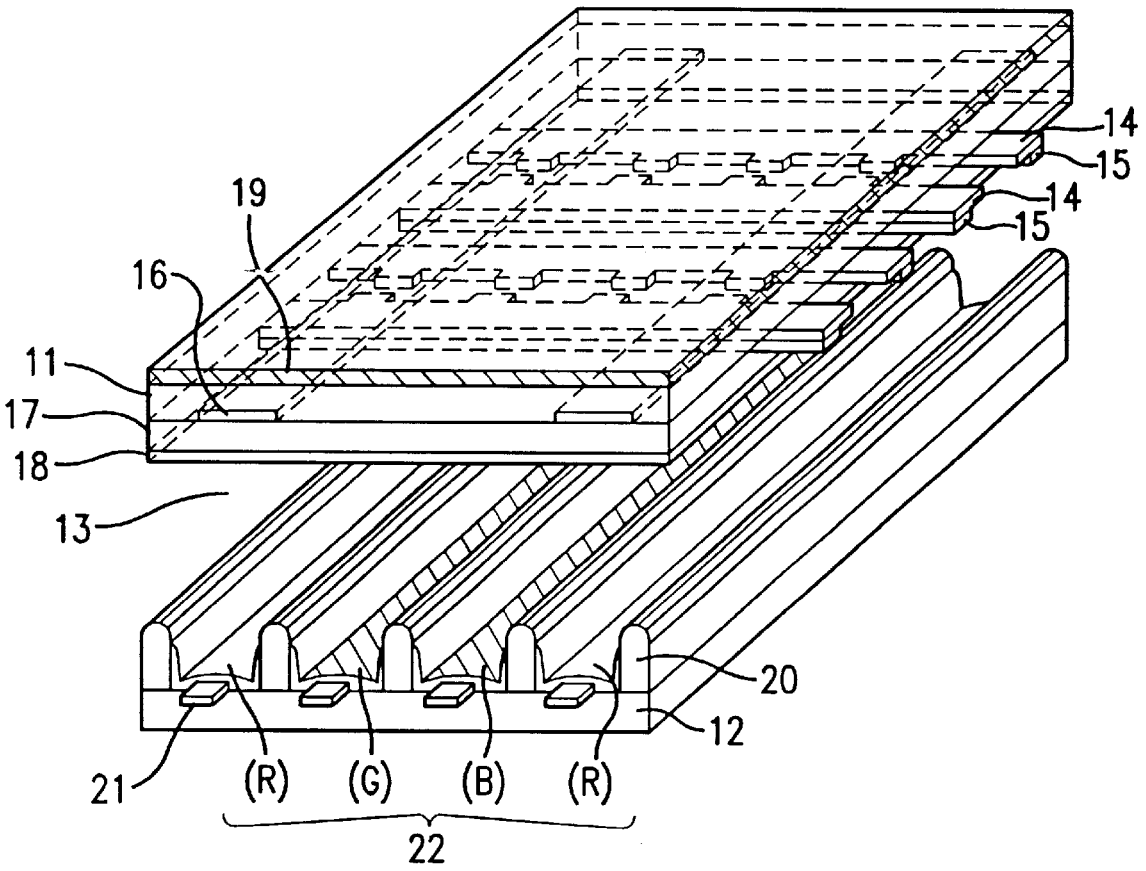
FIG. 10 is a diagram showing structure of the PDP with red light transmitting filters provided on the inner surface of the substrate along with flourescent material layers colored to absorb light in blue and green wavelength regions.
Figure 11:
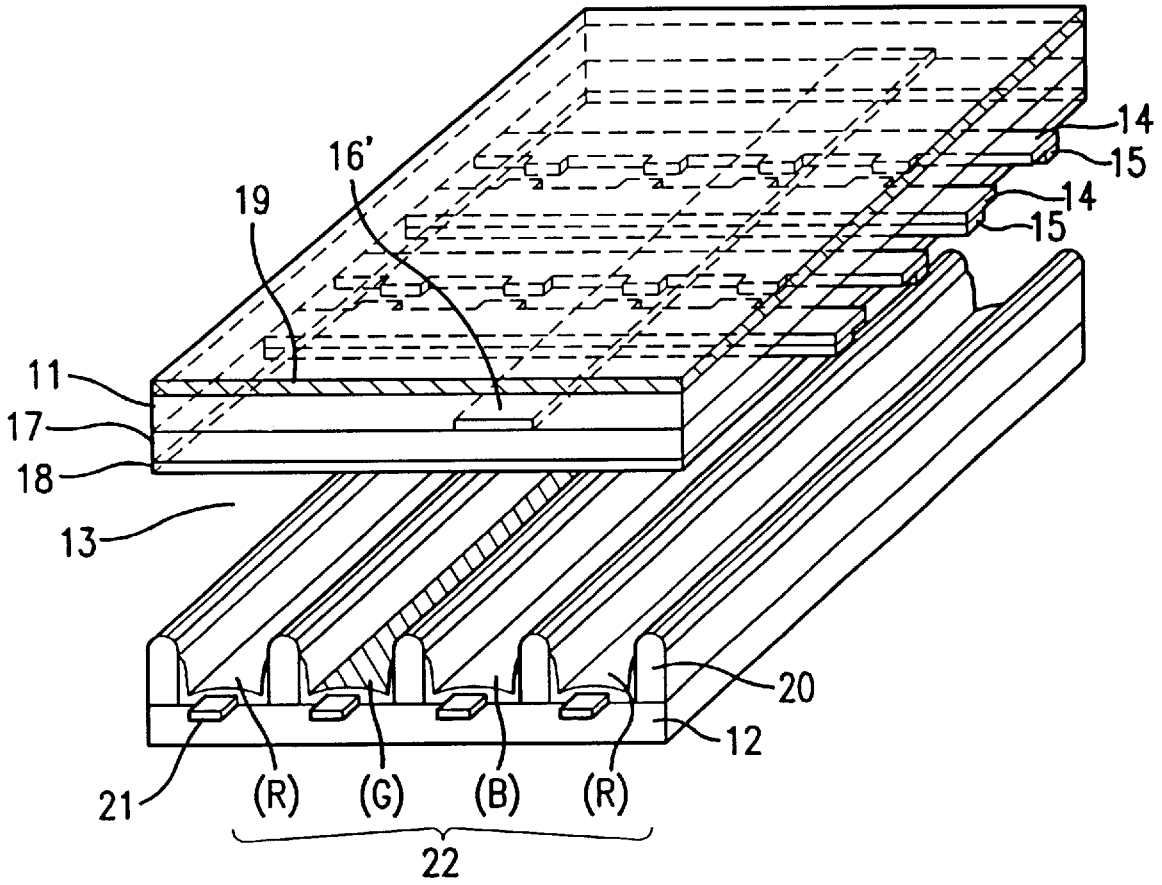
FIG. 11 is a diagram showing structure of the PDP with a blue light transmitting filter provided on the inner surface of the substrate along with a flourescent material layer colored to absorb light in green wavelength regions.
Figure 12:
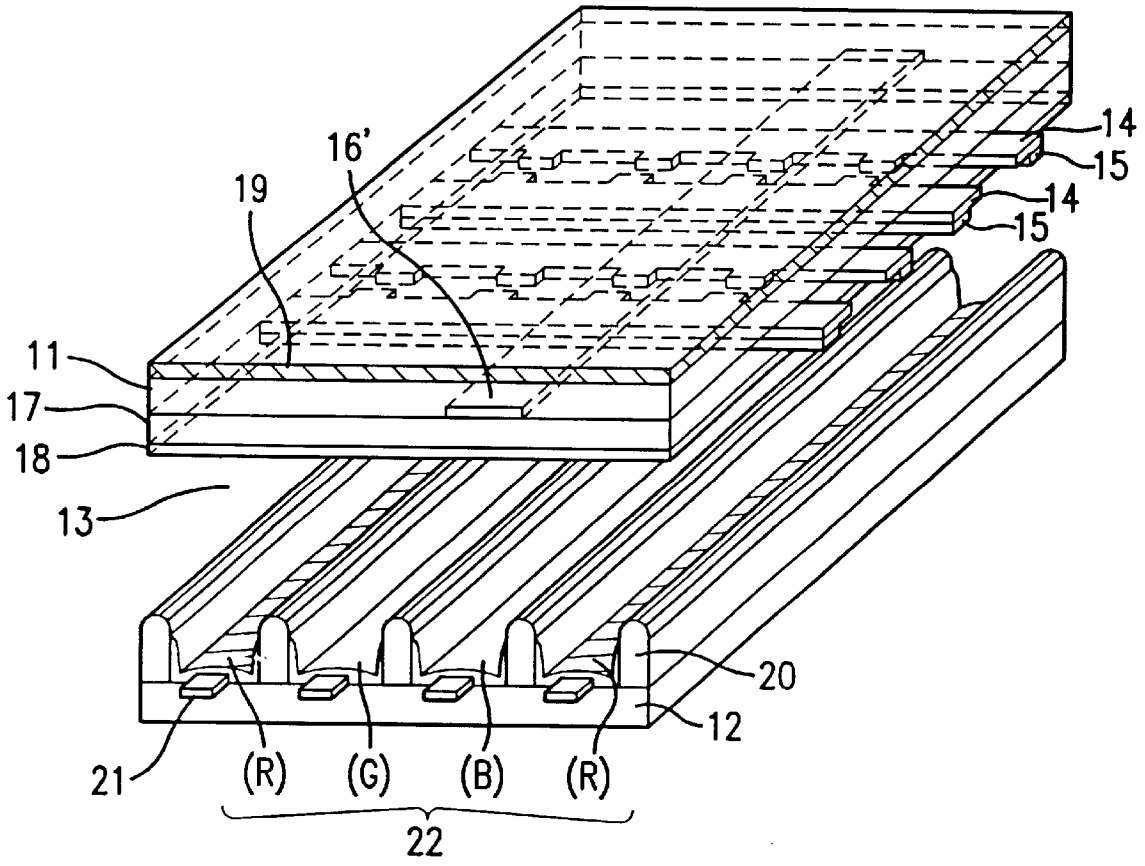
FIG. 12 is a diagram showing structure of the PDP with a blue light transmitting filter provided on the inner surface of the substrate along with flourescent material layers colored to absorb light in red wavelength regions.
Figure 13:
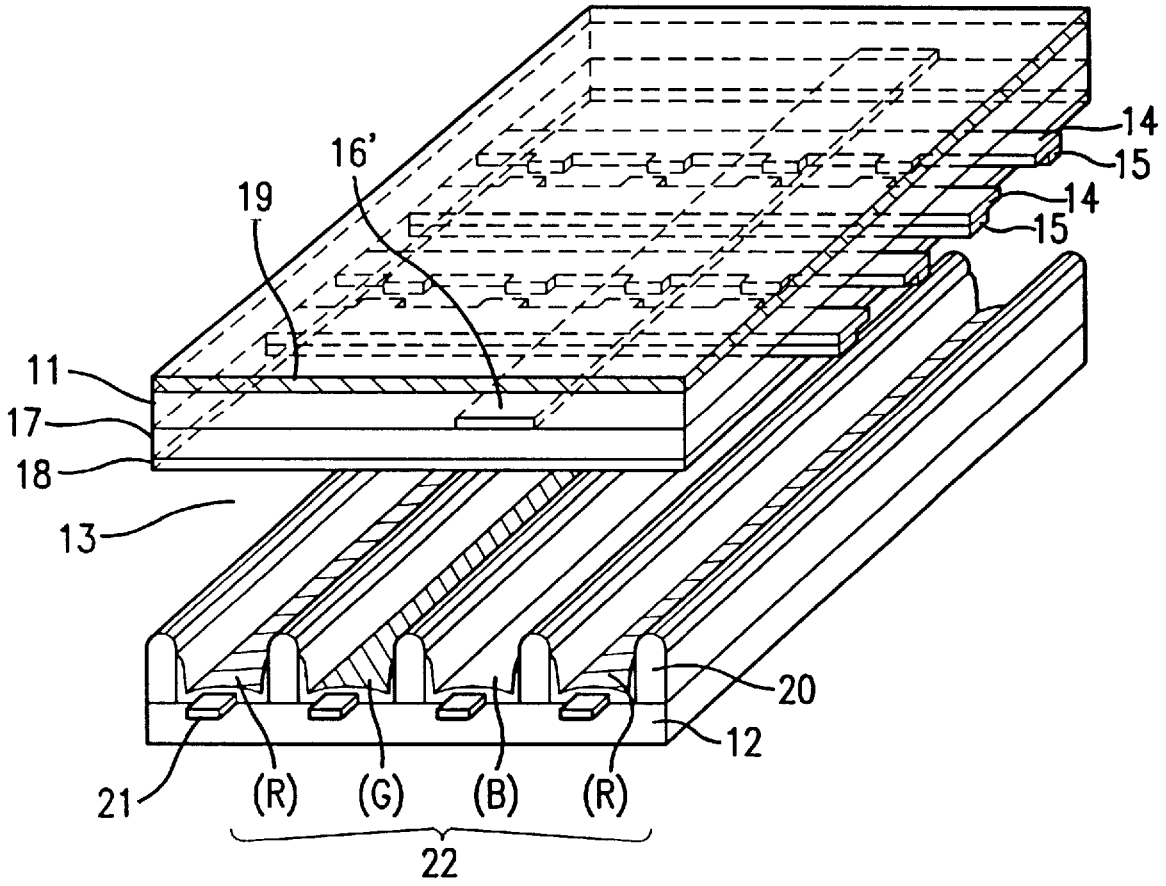
FIG. 13 is a diagram showing structure of the PDP with a blue light transmitting filter provided on the inner surface of the substrate along with flourescent material layers colored to absorb light in red and green wavelength regions.
Figure 14:
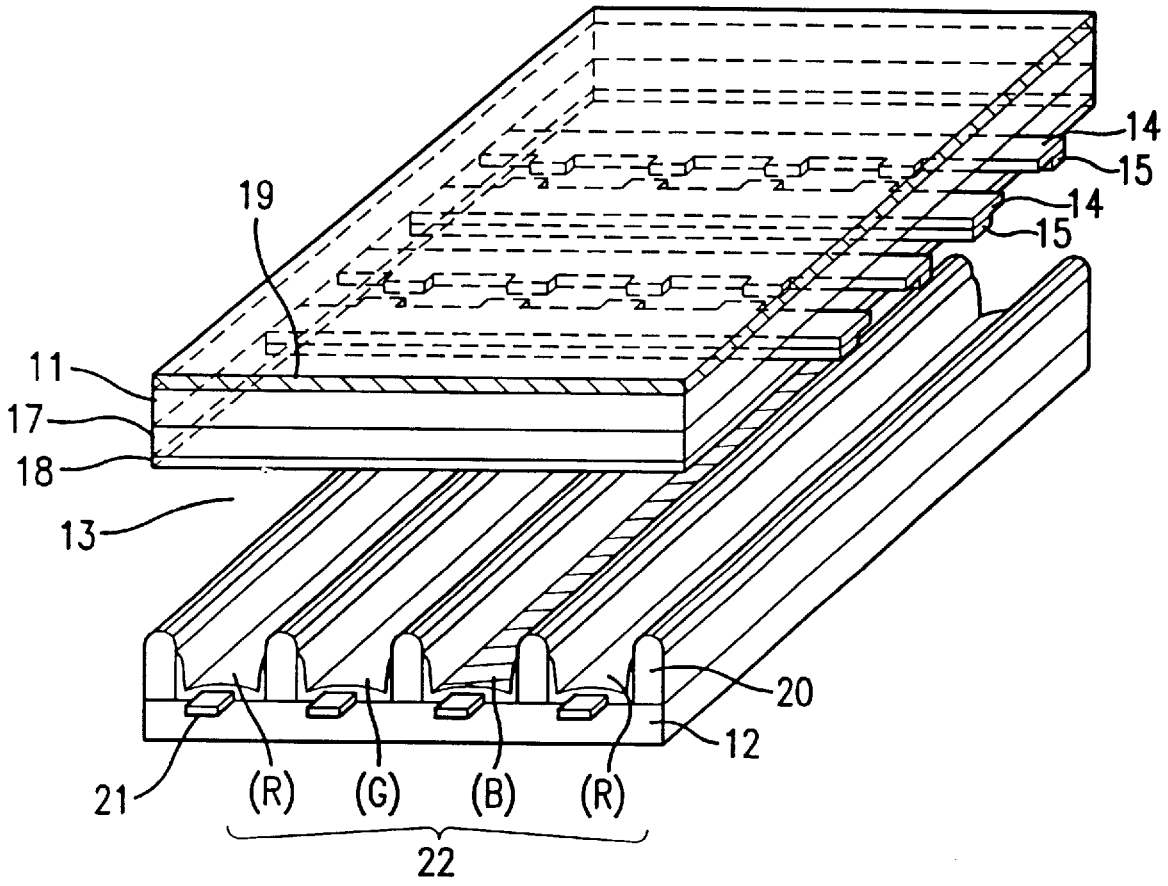
FIG. 14 is a diagram showing structure of the PDP with a flourescent material layer colored to absorb light in blue wavelength regions.
Figure 15:
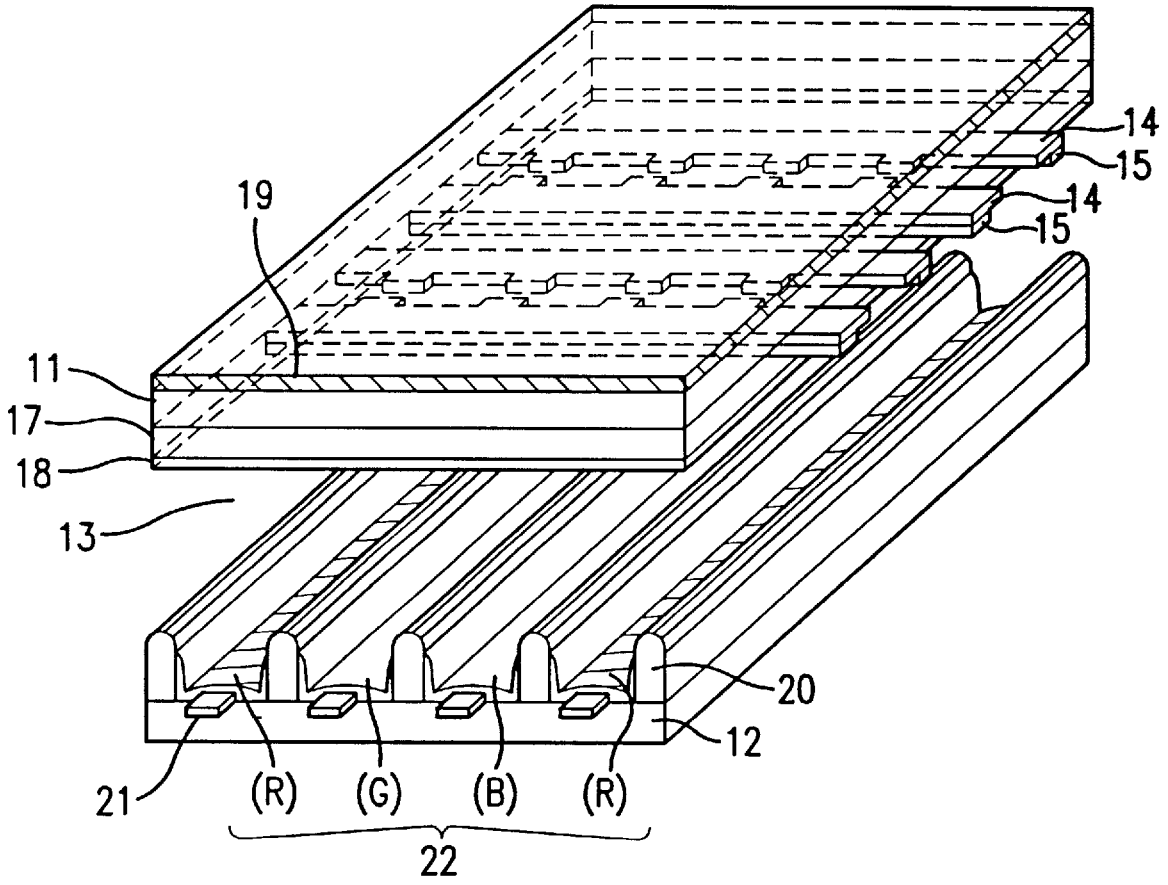
FIG. 15 is a diagram showing structure of the PDP with a flourescent material layers colored to absorb light in red wavelength regions.
Figure 16:
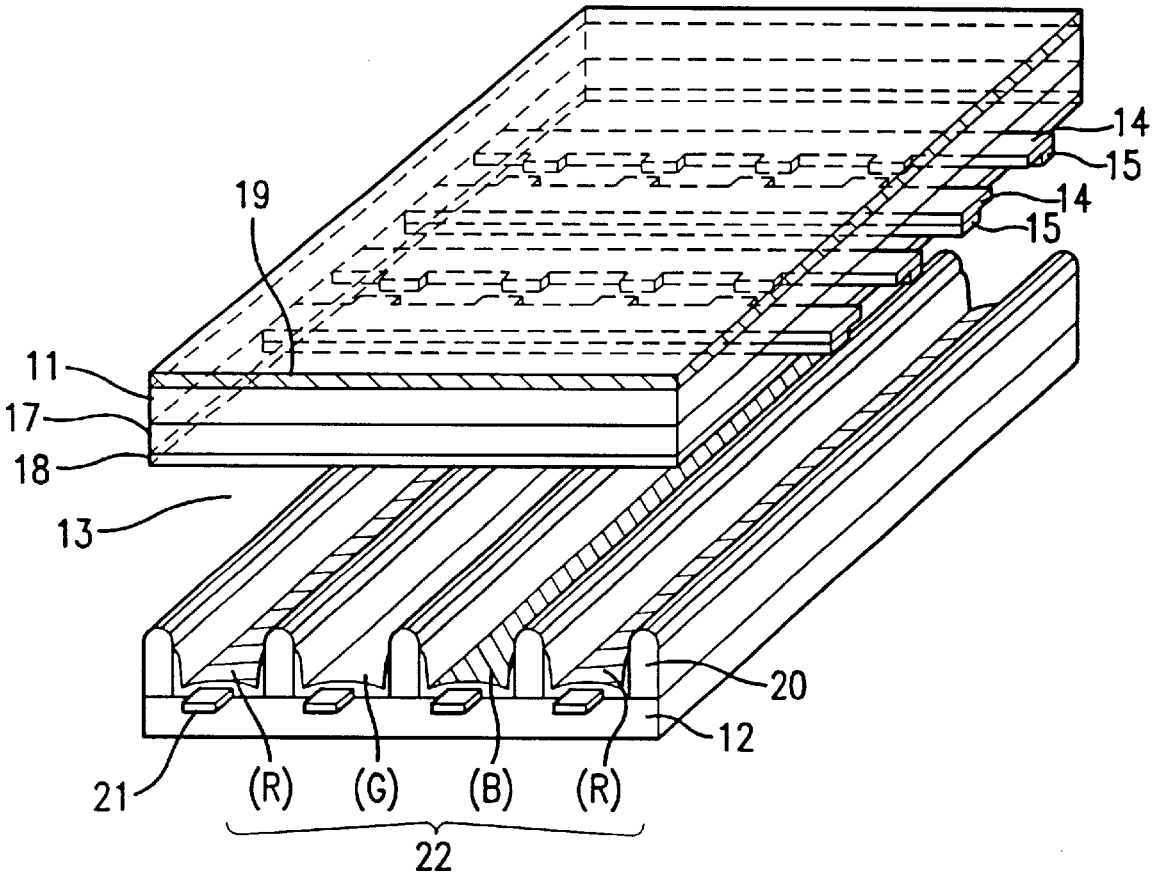
FIG. 16 is a diagram showing structure of the PDP with flourescent material layers colored to absorb light in red and blue wavelength regions.

As mentioned above, by forming a pattern of at least one color of the red or blue light transmitting filter onto the inner surface of the front glass substrate 11, the outside light reflection can be effectively reduced. Therefore, as shown in FIG. 5, in place of the red light transmitting filter, the blue light transmitting filter can be also provided on the inner surface of the substrate on the display surface side corresponding to the blue fluorescent material layer.

The red light transmitting filter is formed in a state where alkali ions in a glass raw material are substituted by an (ion exchange) colored glass thin film metal by stain or metal oxide or is formed by a method whereby after they were substituted, colloids are formed and a color is developed. The red light transmitting filter can be also formed by coating a red pigment and a glass or only the red pigment.

The blue light transmitting filter is obtained by printing a transparent glass paste onto the front glass substrate by using a glass paste for blue color including cobalt oxide or a blue glass paste in which a blue pigment and glass powders are mixed. The blue light transmitting filter can be also formed by coating only the blue pigment.

Although the first embodiment has been described with respect to an example in which either one of the red light transmitting filter and the blue light transmitting filter is formed on the inner surface of the front glass substrate 11, it will be obviously understood that two filters of the red light transmitting filter and the blue light transmitting filter can be also formed.

(Second embodiment)

The second embodiment with respect to the fluorescent materials on the outer surface of the substrate on the display surface side, on the inner surface of the substrate on the display surface side, and on the substrate on the back surface side will now be described.

As a second embodiment, the green light absorbing filter is provided on the outer surface of the substrate on the display surface side and the blue and red light transmitting filters corresponding to the blue and red fluorescent material layers are provided on the inner surface of the substrate on the display surface side. Further, the green fluorescent material layer of the substrate on the back surface side is formed as a colored fluorescent material layer for transmitting the green light, that is, for absorbing light in wavelength regions other than the green light. Consequently, the outside light reflection can be reduced so as to withstand a practical use. In the green light absorbing filter, the transmittance in a wavelength region near 555 nm where the spectral luminance is the highest is about 70% and the transmittances in the red and blue regions are higher than the transmittance in the region near 555 nm by 10% or more.

(Third embodiment)

As a third embodiment, the green light absorbing filter is provided on the outer surface of the substrate on the display surface side and the blue (or red) light transmitting filter corresponding to the blue (or red) fluorescent material layer is provided on the inner surface of the substrate on the display surface side. Further, at least one of the fluorescent material layers other than the blue (or red) fluorescent material layer of the substrate on the back surface side is formed by a colored fluorescent material layer for transmitting a corresponding monochromatic light, that is, for absorbing light in the wavelength regions other than the corresponding monochromatic light. Consequently, the outside light reflection can be reduced so as to withstand a practical use.

(Fourth embodiment)

As a fourth embodiment, the green light absorbing filter is provided on the outer surface of the substrate on the display surface side and is formed by a colored fluorescent material layer for absorbing light in the wavelength regions other than the corresponding monochromatic light of the substrate on the back surface side, thereby enabling the outside light reflection to be reduced so as to withstand a practical use. The green light transmitting filter can be also provided onto the inner surf ace of the substrate on the display surface side in correspondence to the green fluorescent material layer.

As mentioned above, according to the second to fourth embodiments, since the colored fluorescent material layer is used, an increase in the number of manufacturing steps of the substrate on the front side can be suppressed. The colored fluorescent material layer can be formed by a coating and a baking in a manner similar to the conventional fluorescent material layer, so that the number of manufacturing steps of the substrate on the back surface side is not increased. Therefore, a combination adapted to a panel structure and a construction of a panel manufacturing line can be selected among combinations of the filter on the outer surface of the substrate on the display surface side, the filters on the inner surface of the substrate on the display surface side, and the fluorescent materials of the substrate on the back surface side.

At least one of the red light transmitting filter and the blue light transmitting filter is formed in the panel and the green light absorbing filter is attached to the outside of the panel, thereby enabling the outside light reflection to be reduced so as to withstand the practical use. In addition, by limiting the number of colors of the filters formed inside to two colors or less, an increase in costs can be suppressed. By using the colored fluorescent material layer, the manufacturing steps are simplified and the outside light reflection can be reduced so as to withstand the practical use.

The invention has been described with reference to the preferred embodiments thereof. It will be understood that those skilled in the art can presume many modifications and variations. All of such modifications and variations are incorporated within the scope of claims.

What is claimed is:

1. A plasma display panel, the panel having:

a pair of substrates on a display surface side and a back surface side which are arranged so as to face each other through a discharge space, the panel further having fluorescent material layers of three colors of red, green, and blue provided on an inner surface of the substrate on said back surface side, and in which said fluorescent material layers are allowed to emit light by a discharge, wherein a green light absorbing filter is provided on an outer surface of the substrate on said display surface side and a monochromatic light transmitting filter corresponding to at least one of the red and blue fluorescent material layers which face each other through said discharge space is provided on the inner surface of the substrate on said display surface side.

2. A panel according to claim 1, wherein said green light absorbing filter has transmitting characteristics in which a transmittance in a wavelength region near 555 nm lies within a range from 40 to 80% and maximum transmittances in wavelength regions of the red and blue light are higher than the transmittance at 555 nm by 10% or more.

3. A panel according to claim 1, wherein monochromatic light transmitting filters corresponding to said red and blue fluorescent material layers are provided on the inner surface of the substrate on said display surface side, each of said monochromatic light transmitting filters faces a corresponding one of said red and blue flourescent material layers through said discharge space, and said green fluorescent material layer is formed by a fluorescent material layer colored so as to allow the green light to pass therethrouqh.

4. A panel according to claim 1, wherein a red light transmitting filter corresponding to said red fluorescent material layer is provided on the inner surface of the substrate on said display surface side, said red light transmitting filter faces said red flourescent material layer through said discharge space, and at least one of said green and blue fluorescent material layers is formed by a fluorescent material layer colored so as to allow the corresponding monochromatic light to pass therethrouqh.

5. A panel according to claim 1, wherein a blue light transmitting filter corresponding to said blue fluorescent material layer is provided on the inner surface of the substrate on said display surface side, said blue light transmitting filter faces said blue flourescent material layer through said discharge space, and at least one of said red and green fluorescent material layers is formed by a fluorescent material layer colored so as to allow the corresponding monochromatic light to pass therethrouqh.

6. A plasma display panel which has a pair of substrates on a display surface side and a back surface side which are arranged so as to face each other through a discharge space and fluorescent material layers of three colors of red, green, and blue provided on an inner surface of the substrate on said back surface side, and in which said fluorescent material layers are allowed to emit light by a discharge, wherein a green light absorbing filter is provided on an outer surface of the substrate on said display surface side and at least one of said red and blue fluorescent material layers is formed by a fluorescent material layer colored so as to absorb light in wavelength regions other than the corresponding monochromatic light to pass therethrouqh.

7. A panel according to claim 6, wherein said green light absorbing filter has transmitting characteristics in which a transmittance in a wavelength region near 555 nm lies within a range from 40 to 80% and maximum transmittances in wavelength regions of the red and blue light are higher than the transmittance at 555 nm by 10% or more.

8. A panel according to claim 6, wherein a green light transmitting filter corresponding to said green fluorescent material layer is provided on the inner surface of the substrate on said display surface side, said green light transmitting filter facing said green flourescent material through said discharge space.

* * * * *